United States Patent [19]

Tano et al.

[11] Patent Number: 4,828,417

[45] Date of Patent: May 9, 1989

[54] PRINTER HOUSING

[76] Inventors: Osamu Tano, 3396 Kamariyacho, Kanazawa-ku, Yokohama-shi, Kanagawa-ken; Tsugutaka Sugawara, 519-4 Futohcho, Kohoku-ku, Yokohama-shi, Kanagawa-ken, both of Japan

[21] Appl. No.: 170,685

[22] Filed: Mar. 17, 1988

Related U.S. Application Data

[63] Continuation of Ser. No. 915,243, Oct. 2, 1986, abandoned.

[51] Int. Cl.[4] ..... B41J 13/10

[52] U.S. Cl. ..... 400/616; 400/647.1; 400/693

[58] Field of Search ..... 400/642, 647, 647.1, 400/691, 692, 693, 694, 605, 690.4, 616, 616.1, 616.2, 616.3

[56] References Cited

U.S. PATENT DOCUMENTS 4,586,839 5/1986 Iwagami ..... 400/691 X
4,641,982 2/1987 Rekewitz ..... 400/690.4 X

FOREIGN PATENT DOCUMENTS 116182 7/1983 Japan ..... 400/691
147369 8/1985 Japan ..... 400/647.1
204964 10/1923 United Kingdom ..... 400/691

*Primary Examiner*—Charles Pearson
*Attorney, Agent, or Firm*—Albert L. Jeffers; Anthony Niewyk

[57] ABSTRACT

A printer housing which can be adapted for both cut sheet printing paper and continuous printing paper without replacing any of its paper guide members with any external paper guide members. The printer housing comprises a first cover which is pivotably supported at its front end and a second cover which is povoted to the first cover at its middle part and can cover an opening in the upper face of the printer housing main body by complementing the first cover. When the second cover is thus covering the upper opening of the printer housing main body in cooperation with the first cover, the printer housing is adapted for continuous printing paper. When the second cover is brought to an oblique position, the second cover can serve as a guide for feeding cut sheet printing paper into the printer. The printer is preferably provided with a tractor feeder which can be thrown backward to be out of way for cut sheet printing paper and to support the second cover at its oblique position.

3 Claims, 4 Drawing Sheets

PRINTER HOUSING

This is a continuation of application Ser. No. 915,243, filed Oct. 2, 1986, now abandoned.

TECHNICAL FIELD

The present invention relates to a housing for a printer and in particular to a printer housing which is adapted for both continuous and cut sheet printing paper.

BACKGROUND OF THE INVENTION

A conventional printer, such as a dot matrix impact printer, a dot matrix thermal printer, a daisy wheel printer, or the like is typically provided with an arrangement for feeding printing paper. The printing paper may be either cut sheet paper or continuous paper depending on the particular application of the printer, and the paper feeding system must be arranged accordingly, typically at the time of initially installing the printer. Typically, the printer is initially provided with two different adapters for continuous and cut sheet printing paper but the adapter for say feeding continuous paper must be kept separate from the printer when the printer is to be set up for handing cut sheet paper and it has been felt as extremely cumbersome because the unused adapter must be safely kept somewhere else so that it can be used for replacing the adapter installed on the printer when the printing paper is to be switched from continuous paper to cut sheet paper. Also, the work required for replacing the adapters is cumbersome and disrupting, and therefore imposes inconveniences on the user.

BRIEF SUMMARY OF THE INVENTION

In view of such inconveniences of conventional printer housings, a primary object of the present invention is to provide a printer housing which is adapted for both continuous and cut sheet printing paper.

Another object of the present invention is to provide a printer housing which does not require removal of any component part for adapting the printer from the continuous paper to cut sheet paper or vice versa.

Another object of the present invention is to provide a printer housing which can be readily converted from one state for handling either one of continuous printing paper and cut sheet printer paper to the other state for handling the other of the two forms of printing paper.

According to the present invention, such an object is accomplished by providing a printer housing for a printer which is provided with paper feeding means for both cut sheet printing paper and continuous printing paper, comprising: a housing main body which accommodates the printer and the paper feeding means therein and defines an opening at least in the upper face of the rear part thereof; a first cover which is pivoted, at its front end, to the printer housing main body to be forwardly rotatable about a first lateral axial line from its horizontal normal position, and is provided with an opening in its rear part; and second cover which is pivoted at an intermediate part thereof about a second axial line which is substantially parallel to the first axial line so as to be rotatable from a first position at which it covers the opening of the first cover and a second position at which the second cover is held at an oblique angle which is suitable for guiding cut sheet paper.

According to a certain aspect of the present invention, the first cover and the second cover substantially cover the opening of the printer housing main body by complementing each other when the first cover is at its normal position while the second cover is at its first position. Thus, the paper guide member for cut sheet printing paper serves as the second part of the printer cover and no part of the housing needs to be removed for adapting the printer to different printing paper.

According to another aspect of the present invention, the second cover is brought to and held at the oblique angle when it is at its second position by the rear end of the second cover coming into contact with a paper feeder which is adapted for feeding cut sheet paper. Therefore, the printer cover automatically adapts itself to cut sheet printing paper simply by the second part being pushed against the paper feeder as the printer cover is closed over the paper feeder.

BRIEF DESCRIPTION OF THE DRAWINGS

The present invention will now be shown and described in the following in terms of a concrete embodiment thereof with reference to the appended drawings, in which.

DESCRIPTION OF THE PREFERRED EMBODIMENT(S)

Figure 1:
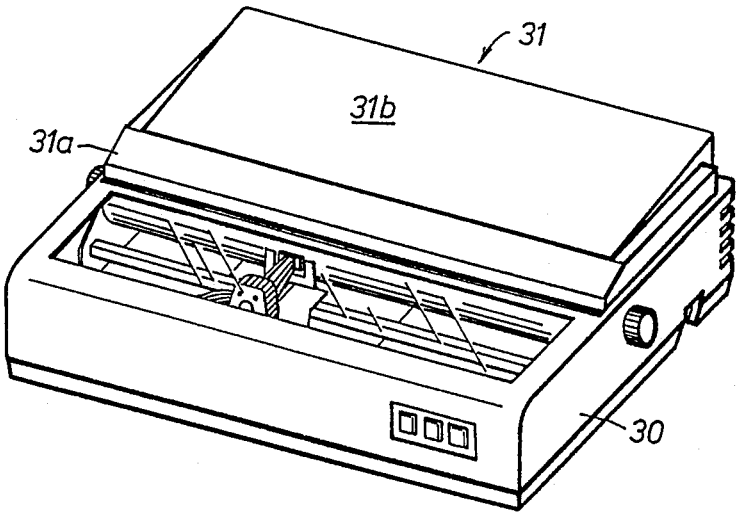
FIG. 1 is a perspective view of an embodiment of the printer housing of the present invention when it is adapted for continuous printing paper.
Figure 3:
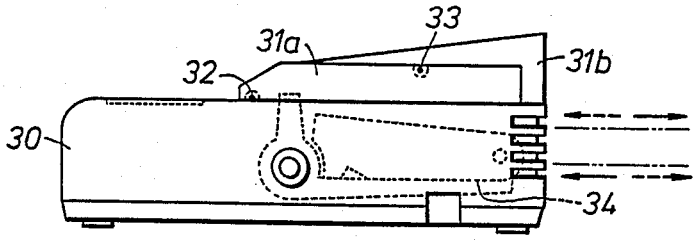
FIGS. 3 to 6 are schematic side views of the printer housing of the present invention illustrating the procedure for bringing the state of the printer from that shown in FIG. 1 to that shown in FIG. 3.

FIGS. 1 and 3 show an embodiment of the printer housing of the present invention when it is adapted for continuous printing paper. A paper feeder 34 is accommodated within a housing main body 30, and an opening provided in the upper face of the rear part of the printer housing main body 30 is closed by a printer cover 31. The printer cover 31 consists of two parts; the first part 31*a* is hinged, at its front end, to the upper face of the main body 30 adjacent to the front end of the opening by way of a lateral pivot shaft 32 while the second part 31*b* is pivoted, at its intermediate part, to the first part 31*a* of the printer cover 31 by way of another lateral pivot shaft 33.

In the state illustrated in FIGS. 1 and 3, the two parts 31*a* and 31*b* of the printer cover 31 form a single cover which covers the opening in the upper face of the rear part of the printer housing main body 30 so that the paper feeder 34 can be totally covered by the printer cover 31. Continuous printing paper can be fed into and out of the printer within the main body 30 from the rear as shown by imaginary lines in FIG. 3.

Figure 7:
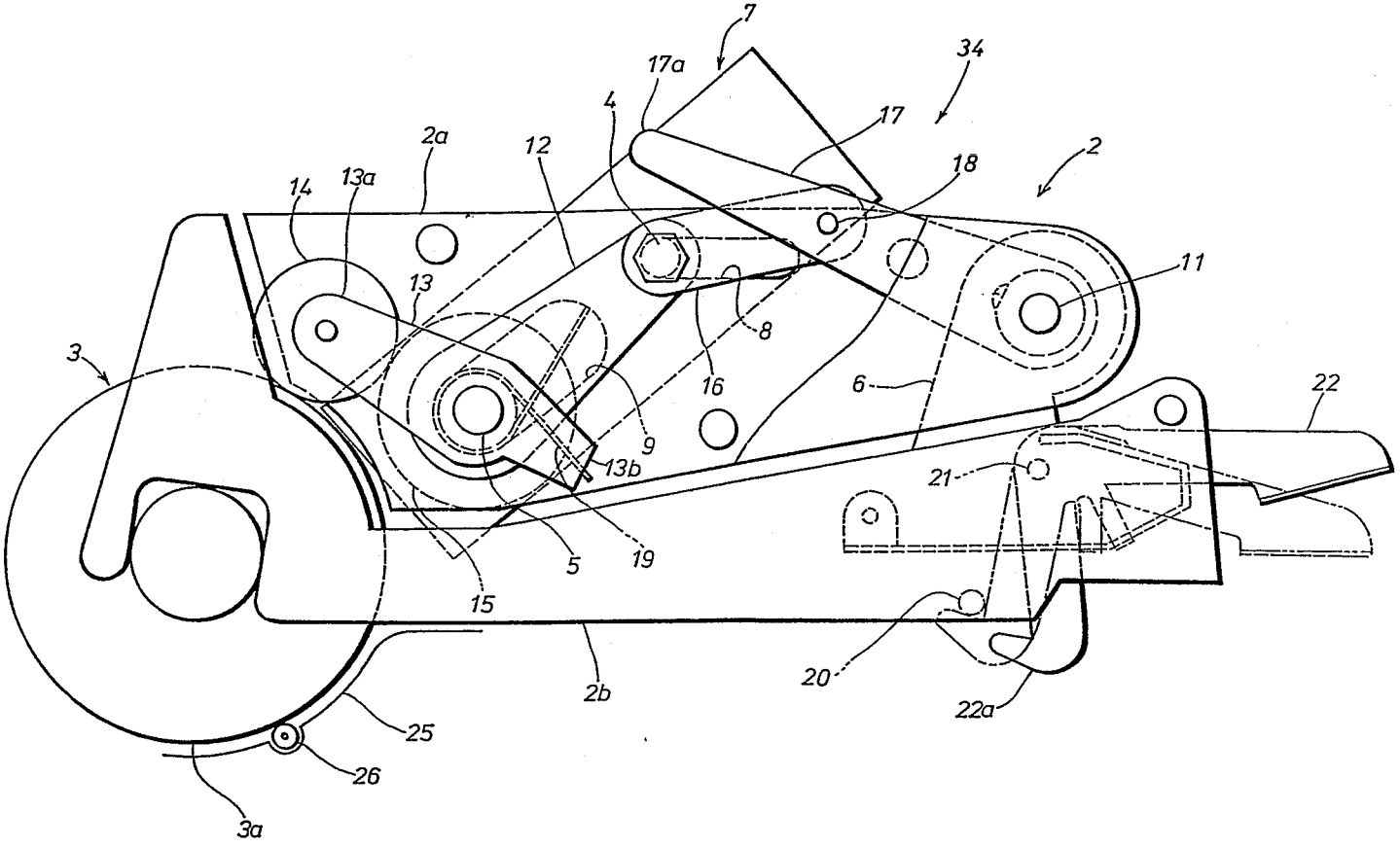
FIGS. 7 and 8 show the paper feeder in two different states.
Figure 9:
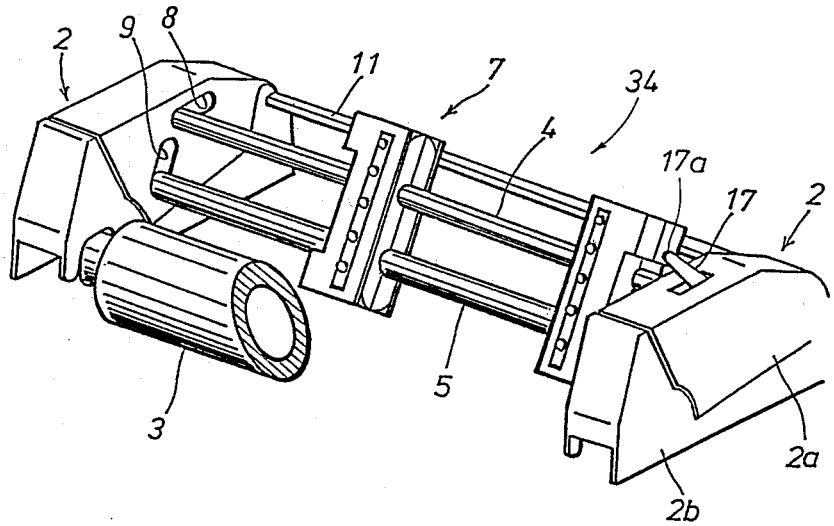
FIG. 9 is a partly broken away perspective view of the paper feeder.

FIGS. 7 and 9 show the paper feeder 34 in greater detail. A columnar platen 3 and a pair of lateral shafts 4 and 5 extend laterally across a pair of frame members 2 which are provided on either side of the printer housing. A pair of tractor feeder units 7 are fitted over the lateral shafts 4 and 5 so as to be slidable along the lateral directions are adapt themselves to different widths of continuous printing paper.

The frames 2 are each divided into an upper and a lower part, and the upper frame 2a is rotatably supported, by way of a pivot shaft 11, by a pair of support plates 6 which are in turn supported by the rear part of the lower frame 2b. Each of the two lateral ends of the lateral shafts 4 and 5 are respectively received in a substantially horizontal slot 8 and another slot 9 which inclines upwards toward the rear. The internal structures of the frames 2 are identical to each other except for certain slight differences. Therefore, in the following description, only one of the two frames 2 is described and the slight differences is described hereinafter.

The end of the lateral shaft 4 which is passed through the frame 2 is fixedly attached to a connecting plate 12 and the other end of the connecting plate 12 rotatably supports the corresponding end of the other lateral shaft 5. The very same end of the lateral shaft 5 is also pivoted to an intermediate portion of a link 13 and an end **13*a* of the link 13 rotatably supports a gear 14 while the other end 13*b* of the link 13 is engaged to an end of a torsion coil spring 19 which biases the link 13 in counter clock-wise direction in the sense of FIG. 7**.

The gear 14 is meshed with another gear 15 which is fixedly secured to the corresponding end of the lateral shaft 5 and with a third gear **3*a* which is fixedly secured to the platen 3. Therefore, when the platen 3 is rotatably driven by a drive means which is not shown in the drawings the torque is transmitted from the platen 3 to the lateral shaft 5 by way of the gears 3*a*, 14 and 15 to drive the tractor feeder units 7. Each of the tractor feeder units 7** is provided with pins which engage with the perforations provided on both side edges of the continuous printing paper.

The end of the lateral shaft 4 received in the frame 2 is pivotably connected to a link 16 and the other end of the link 16 is connected, by way of a pin 18, to an intermediate point of an arm 17 which is pivotably supported by the pivot shaft 11. The free end 17a of the arm 17 projects out from a slot provided in the upper surface of one of the frames 2, but the arm 17 in the other frame 2 lacks such a free end as shown in FIG. 9 and the arm 17 of the other frame extends only between the pin 18 and the pivot shaft 11. On the other hand, in the other frame 2, the corresponding ends of the lateral shafts 4 and 5 are simply received in slots which are identical to the slots 8 and 9 and are mutually connected by a connecting plate which is identical to the connecting plate 12. Thus, these ends of the lateral shafts 4 and 5 received in this frame 2 follow the motion of the other ends of the lateral shafts 4 and 5 received in the other frame 2.

A lever 22 is pivoted to the rear part of the lower frame **2*b*, and the frame 2 can be removed from the main body of the printer by disengaging an engagement portion 22*a* provided on one end of the lever 22 from an engagement pin 20 provided on the side of the printer main body 30. The lower circumferential surface of the platen 3 is in contact with a roller 26 which is rotatably supported by a shaft which is parallel to the platen 3 and a paper guide 25** consisting of an arcuately curved plate is provided adjacent thereto.

Thus, in the state shown in FIGS. 1 and 3, the continuous paper is introduced from an opening (which is not shown in the drawings) provided in the rear part of the second portion **31*b* of the printer cover 31 and, after passing through the platen 3**, is taken out to the rear of the printer through the same opening.

Figure 2:
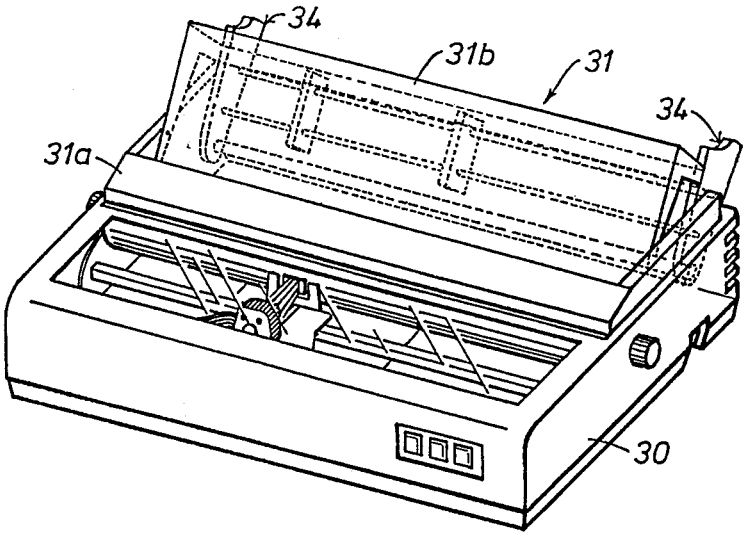
FIG. 2 is a perspective view of the printer housing of FIG. 1 when it is adapted for cut sheet printing paper.
Figure 6:
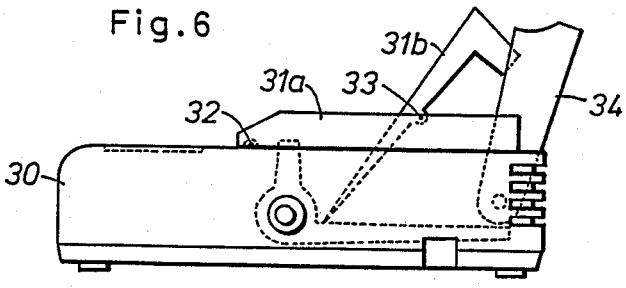
Figure 8:
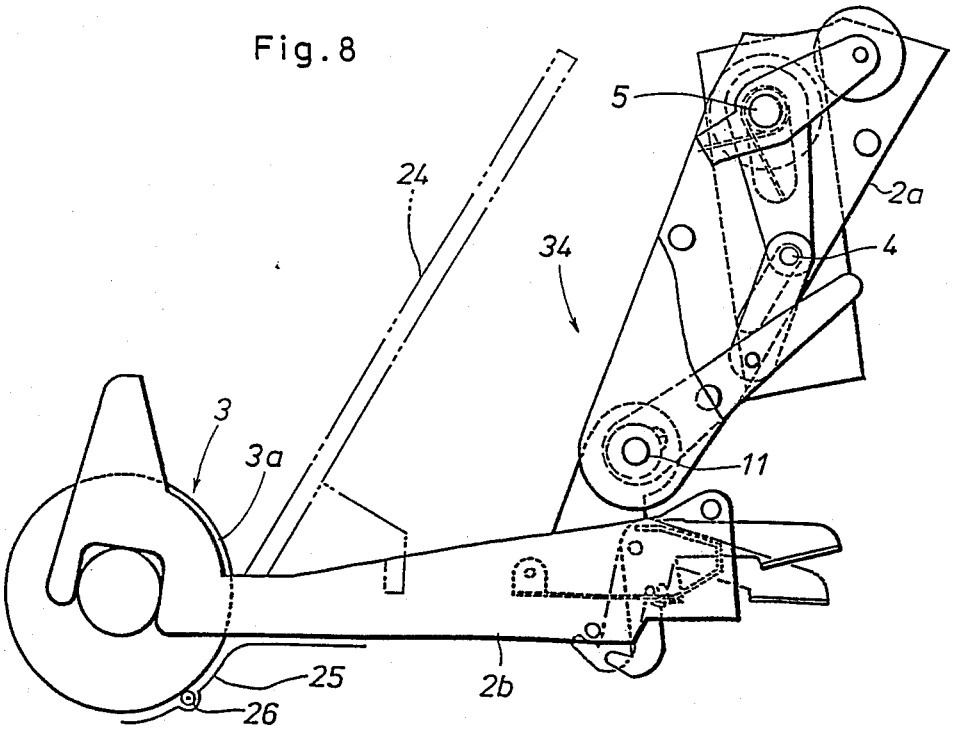

FIGS. 2 and 6 show the state of the printer cover 31 while FIG. 8 shows the state of the paper feeder 34 in greater detail when cut sheet paper is used or when the paper is to be fed by the friction of the platen 3 only. In this case, the paper feeder 34 is thrown backward by a rotation thereof about the pivot shaft 11 and the first part **31*a* of the printer cover 31 is in the same state as it was in the previous case while the second part 31*b* of the printer cover 31 has been rotated downwards about the pivot shaft 33 until its upper surface is aligned with tangential direction of the platen. As shown in FIGS. 2 and 6, the rear end of the second part 31*b* of the printer cover 31 is engaged to the paper feeder 34 so as to keep the second part 31*b*** in the inclined or oblique position.

Thus, in this state, the cut sheet paper can be placed on the upper surface of the second part **31*b* of the printer cover 31 and fed into the nip between the platen 3 and the roller 26. The cut sheet paper which has passed through the platen 3** is ejected to the front of the printer.

More detailed description of the operatin of the paper feeder 34 will be found in Patent Applications Ser. Nos. 915,154 and 915,155 filed by Norio Kawashima, et al. on the same day as this application.

Now, the operation of the printer cover of the present embodiment is described in the following with reference to FIGS. 3 to 6.

Figure 4:
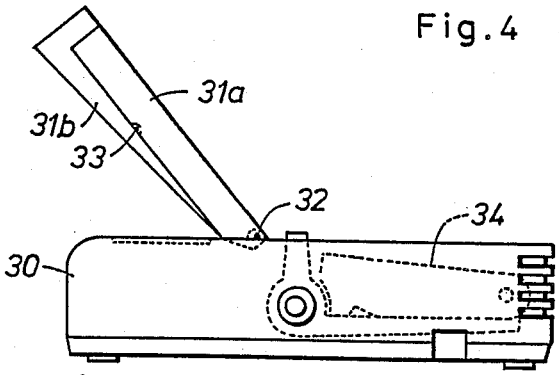
Figure 5:
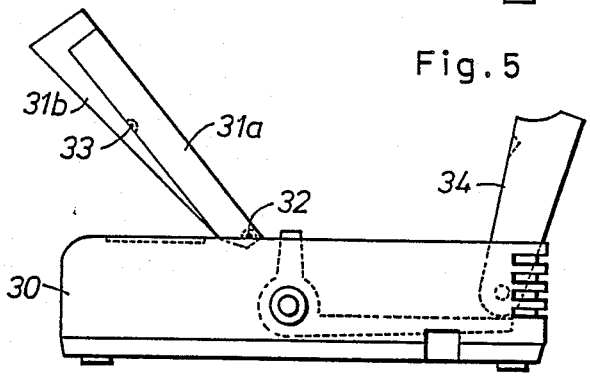

FIG. 3 shows the printer when it is adapted for continuous printing paper. The printer cover 31 can be pivoted from this normal position to the front about the pivot shaft 32 as shown in FIG. 4 and, then, the paper feeder 34 can be thrown backward as shown in FIG. 5. Then, by rotating the printer cover 31 backward, the first part **31*a* of the printer cover 31 is restored to the original normal position while the second part 31*b* comes into engagement with the paper feeder 34, in particular the upper frame 2*a*, and is brought to the inclined position as shown in FIG. 6. Thus, the second part 31*b* is set up at an angle which is suitable for feeding cut sheet paper therealong with its upper surface aligned with a tangential direction of the platen 8**.

Restoring the printer back to the original state for feeding continuous paper can be accomplished by reversing the above described operation.

What we claim is:

1. A printer housing for a printer, said printer having a platen and paper feeding means, said housing comprising:

a housing main body which houses the printer and the paper feeding means therein;

a first opening in the upper face of a first part of said housing main body;

a first cover forming an integral part of said printer housing main body and pivotably secured at a first end to the printer housing main body, said first cover being pivotable about a first lateral axial line located at said first end from a first position to a second position, said first cover having a second opening in the second end thereof;

a second cover which is pivotably secured to the first cover at a generally intermediate midportion thereof located between first and second ends of said second cover for pivoting about a second lateral axial line which is substantially parallel to the first lateral axial line, from a first position at which said second cover covers the second opening of the first cover to a second position at which the second cover is held in a slanted position wherein said second cover forms an acute angle with respect to a horizontal plane, a first portion of said second cover in the second position thereof extending into said housing tangentially to said platen for supporting cut paper and guiding said cut paper to said printer, said first portion, in said second position thereof, terminating directly adjacent said platen.

2. A printer housing as defined in claim 1, wherein the paper feeding means comprises tractor feed means for feeding a continuous strip of paper, and the second cover second end is held in the slanted position when it is at its second position by contacting the second end of the second cover with the tractor feed means.

3. A printer housing as defined in claim 1, wherein the second cover includes a first part which cooperates with a first part of the first cover and a second part which cooperates with a second end of the first cover, said first and second cover thereby forming a unitary cover.

* * * * *